US005267428A

United States Patent [19]

Mayo

[11] Patent Number: 5,267,428

[45] Date of Patent: Dec. 7, 1993

[54] CARGO CARRIER FOR PACK ANIMALS

[76] Inventor: Jerry Mayo, P.O. Box 2292, Winnemucca, Nev. 89446

[21] Appl. No.: 958,176

[22] Filed: Oct. 8, 1992

[51] Int. Cl.[5] ..... B68C 1/00

[52] U.S. Cl. ..... 54/37.1

[58] Field of Search ..... 54/37.1, 40.1; 224/905

[56] References Cited

U.S. PATENT DOCUMENTS

| | | | |
|---|---|---|---|
| 413,501 | 10/1889 | Egger | 224/905 X |
| 501,821 | 7/1893 | Browne | 224/905 X |
| 618,329 | 1/1899 | Calvert | 54/37.1 |
| 806,781 | 12/1905 | Daly . | |
| 1,175,731 | 3/1916 | Enyeart . | |
| 1,239,756 | 9/1917 | Bader et al. | 54/37.1 |

*Primary Examiner*—Robert P. Swiatek

*Attorney, Agent, or Firm*—Kokjer, Kircher, Bowman & Johnson

[57] ABSTRACT

A cargo carrier for pack animals having a side wall and a bottom wall, with the bottom wall extending outwardly from a lower edge of the side wall. Both of these walls are preferably formed as a single monolithic unit of rigid material, such as aluminum. The side wall is curved about at least one line located on a side of the side wall opposite to that of the direction of extension of the bottom wall. As such, this curvature may conform to the side of the animal, thus distributing the pressure of the carrier and load more evenly upon the animal and providing greater comfort. Various straps may be provided to hang the side wall, and thus the bottom wall and cargo from a crosstree saddle, or other type of pack saddle. Various rings and straps are provided with the side and bottom walls to secure the cargo thereto.

8 Claims, 1 Drawing Sheet

CARGO CARRIER FOR PACK ANIMALS

BACKGROUND OF THE INVENTION

1. Field of the Invention

The present invention relates in general to the carriage of cargo by animals. In particular, the present invention relates to an improved device for holding cargo upon a pack animal.

2. Description of the Related Art

It has long been known to fit animals with pouches or saddlebags such that the animal will support and carry the load of cargo carried within the pouches. For bulkier items, it has been known to provide a pack saddle in the form of a thick padded blanket having front and rear pairs of angled projections extending upwardly therefrom. These angled projections provide tying points for cargo supported on each side of the animal. Such saddles are typically known as a crosstree saddle.

To provide further support for the cargo and to aide in maintaining bulky cargo in position, it has been known to provide a luggage carrier which will attach to the crosstree saddle, as shown in U.S. Pat. No. 618,329 to Calvert. This cargo carrier consist of a planar upstanding wall adapted to lie against the side of the pack animal when hung from the crosstree saddle. A horizontally extending shelf is pivotally mounted to the lower edge of the upstanding element. While this arrangement is lightweight and collapsible for easy storage, the horizontal shelf is maintained in position by a pair of support wires extending between the upstanding wall and shelf at the front and rear sides thereof. The support wires thus limit the length of objects which may be placed upon the carrier, reducing its utility.

SUMMARY OF THE INVENTION

An object of the present invention is to provide a cargo carrier for pack animals which may accept a wide variety of shapes and sizes of cargo.

Another object of the present invention is to provide such a carrier which is lightweight yet sturdy.

Yet another object of the present invention is to provide such a carrier which will be comfortable for the pack animal.

These and other objects are achieved by a cargo carrier for pack animals having a side wall and a bottom wall, with the bottom wall extending outwardly from a lower edge of the side wall. Both of these walls are preferably formed as a single monolithic unit of rigid material, such as aluminum. The side wall is curved about at least one line located on a side of the side wall opposite to that of the direction of extension of the bottom wall. As such, this curvature may conform to the side of the animal, thus distributing the pressure of the carrier and load more evenly upon the animal and providing greater comfort. Various straps may be provided to hang the side wall, and thus the bottom wall and cargo from a crosstree saddle, or other type of pack saddle. Various rings and straps are provided with the side and bottom walls to secure the cargo thereto.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
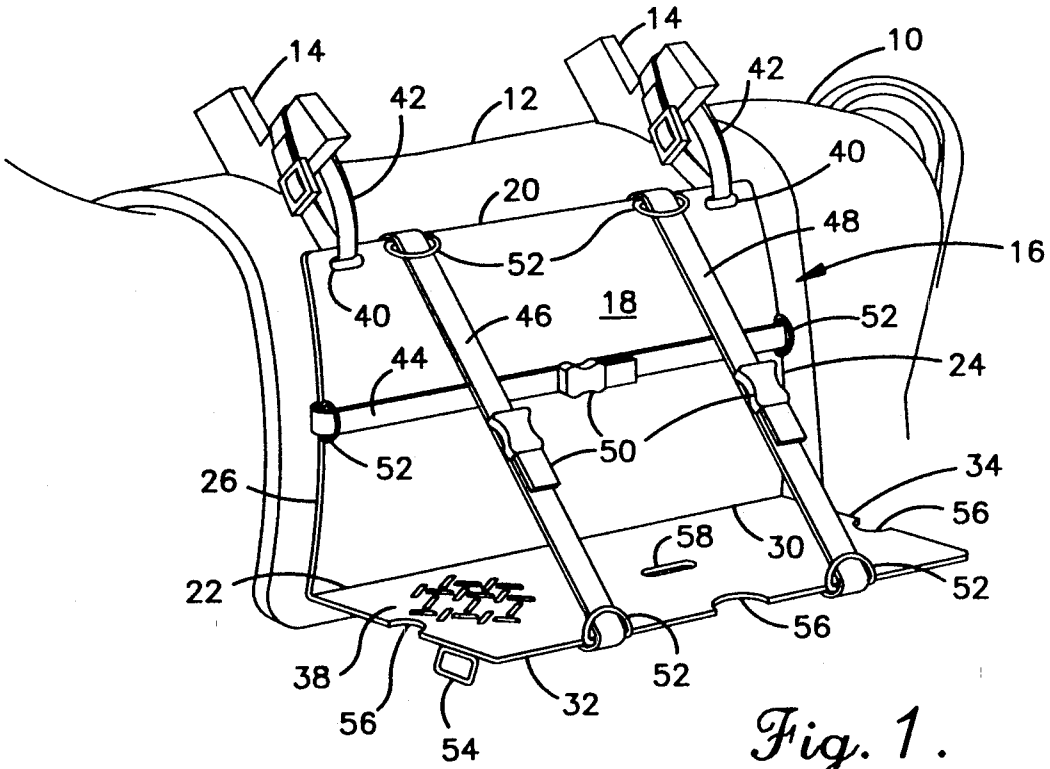
FIG. 1 is a perspective view of a device according to the present invention mounted upon a pack animal.

With reference to FIG. 1, a pack animal is designated by reference numeral 10, and may be a horse, llama, dog or other pack animal. The animal 10 is fitted with a prior art crosstree saddle having a thick blanket 12 and forward and rear crosstrees 14 in the form of rigid angular projections having a general V-shape in the lateral direction of the pack animal. It should be apparent that other types of saddles could of course be employed.

A device according to the present invention is generally designated by reference numeral 16. The device 16 includes a side wall 18 having a generally rectangular configuration including top and bottom edges 20 and 22 and right and left edges 24 and 26. The device also includes a bottom wall 28, also having a substantially rectangular configuration with inner and outer edges 30 and 32, and right and left edges 34 and 36. The bottom wall 28 is substantially planar and is cantilevered from the bottom edge 22 of the side wall at its inner edge 30. As may be seen in FIG. 1, the side wall 18 is adapted to rest against the side of the animal in use, with the bottom wall 28 extending laterally outward therefrom to define a shelf upon which may be placed cargo. It is preferred that one device 16 be mounted on each side of the animal to evenly distribute the weight of the cargo.

The side wall and bottom wall are preferably formed of a rigid material which will resist corrosion and cold weather. A preferred material for the side wall and bottom wall is bright aluminum. The aluminum forming the side wall and bottom wall is light weight, may be easily formed into the preferred monolithic construction of the side wall and bottom wall, and resists corrosion and cold weather cracking. To provide increased friction between the device and cargo, and thus reduce slippage, it is preferred that at least the upper face of the bottom wall and outer face of the side wall include a an appropriate pattern, such as the tread plate pattern indicate by reference numeral 38.

The side wall and bottom wall are intended to be hung from the crosstrees 14. As such, the side wall is provided with a pair of hanging slots 40 adjacent the top edge 20 and spaced at positions substantially corresponding to the spacing between the crosstrees 14. A hanging loop 42 extends through each of the slots 40, and may be engaged over an associated one of the crosstrees 14 to thus hang the side wall and bottom wall. Each of the hanging loops 42 may advantageously be formed of a length of nylon webbing, having a buckle attached thereto at one end and a plurality of appropriate buckle holes formed through the other end. With this arrangement the buckle may engage the opposite end of the webbing to form the hanging loop 42, and additionally allow the length of the hanging loop to be adjusted.

Figure 2:
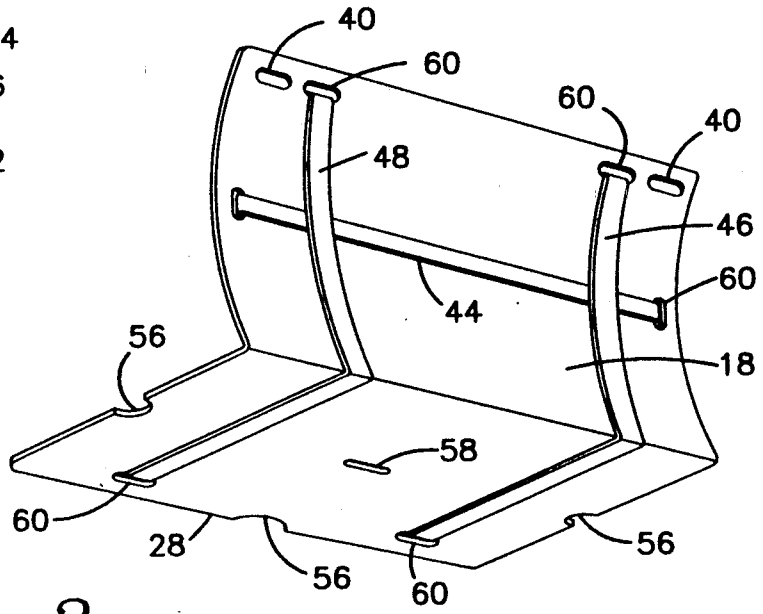
FIG. 2 is a bottom perspective view of a second embodiment according to the present invention.

As may be seen by comparison of FIGS. 1 and 2 (FIG. 2 showing a second embodiment, yet having many common features), the side wall 18 is not planar, but is curved about one or more lines substantially parallel to the top and bottom edges 20 and 22. Such lines would be located on a side of the side wall opposite that of the direction of extension of the bottom wall 28, such that the side wall has a convex configuration adjacent the upper surface of the bottom wall. The curvature of the side wall may be about a single line, such that the side wall is formed as an arc of a circle, about two lines such that it is a portion of an ellipse, or other configurations The particular configuration employed will depend upon the anticipated pack animal with which the device will be employed, as it is preferred that the curvature of the side wall substantially correspond to the average curvature of the side of the pack animal. Providing such curvature will ensure that a greater area of the inner side of the side wall will contact the blanket 12 and animal 10, such that the weight of the cargo and device will be better distributed upon the animal, thus increasing its comfort.

The device also includes various means for maintaining cargo upon the side wall and bottom wall. Such means could take various forms such as numerous hole adjacent the edges to which may be connected resilient "bungee" cords, but preferably take the form of various straps, such as lateral strap 44 and vertical straps 46 and 48. As with the hanging loops 42, the straps may advantageously be formed as lengths of nylon webbing with appropriate means for securing the ends of the webbing together. Due to the changing nature of the cargo, this means to connect the ends of the straps together is preferably a spring biased clamping buckle 50, thus providing greater adjustability than a standard buckle having a projecting member which extends into a preformed hole in the strap.

As may be envisioned from FIG. 2, the straps 44, 46, 48 preferably extend completely about the associated walls, and in particular the strap 44 extends completely about the side wall 18, and the vertical straps 46 and 48 extend completely about both the side wall 18 and bottom wall 28 This arrangement will allow the straps, and thus the buckles 50, to be moved in relation to the associated side walls without changing the tension of the associated strap, thus allowing the buckle to be moved to a more convenient position for the user.

To maintain the straps in their surrounding position about the associated walls, there may be provided guide loops 52 at the top edge 20 of the side wall 18 and outer edge 32 of the bottom wall 28 to maintain the vertical straps 46 and 48 in the proper lateral position. In a similar manner, the side wall 18 may be provided with guide loops 52 at its right and left edges, such that the strap 44 will extend through the loops to maintain it in its horizontal position.

The particular strap arrangement shown in the figures may not be suitable for all cargo which may be used with the device. As such, it is preferred that the device be provided with additional guide loops 54, on the right and left edges of the bottom plate 28 (one such loop only being shown on the left edge of the bottom plate in the drawings). Such additional guide loops may be used as an alternative to the guide loops 52 shown above. For example, the lateral strap 44 may be removed from the guide loops 52 and threaded through the additional guide loops 54 to be in a surrounding relationship about the bottom wall 28. The guide loops 54 will act to prevent movement of the strap 44 inward and outward along the bottom wall.

As a further expedient for attaching additional ropes (not shown) the right and left edges 34 and 36 and the outer edge 32 of bottom plate 28 may include depressions 56 in the form of concave cutouts. Where an additional rope is passed about the cargo and the bottom wall 28, the placement of the rope within one or more of the depressions 56 will help to prevent movement of the rope along the length of the associated edge.

There may optionally be provided other elements for other uses. For example, a slot 58 may be formed through the bottom wall, substantially at the center thereof. The slot 58 will accept therethrough strap having a knot or other enlargement at one of its ends, such that the knot will abut against the upper face of the bottom wall and hang downward. By providing such a strap on each of the pair of devices employed on the animal, the free end of the strap of each device may be passed across the belly of the animal and releasably fixed together, as by a buckle. This will serve to secure the devices to the animal against excessive movement.

A second embodiment of the device according to the present invention is shown in FIG. 2. This second embodiment is similar in all respects except for the means to prevent movement of the straps. In particular, the guide loops 52 have been replaced with guide slots 60 extending through the associated side and bottom walls. These guide slots will allow the straps to pass therethrough and allow movement of the straps therethrough, but restrict movement within the plane of the associated wall. As with the guide loops, the guide slots may be placed at different locations, and/or additional guide slots may be provided.

Various other modifications to the device may of course be made without departing from the scope of the invention. For example, the side wall may include a pair of vertically centrally located placement slots for each of the straps 46 and 48 to pass therethrough. This would ensure that the straps would conform to the curvature of the side wall along its back face, facilitating the pressure distributing feature of the device.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

I claim:

1. A cargo carrier for pack animals, comprising:

a side wall adapted to lie against a side of the pack animal and having top, bottom, right and left edges;

means for hanging said side wall from the pack animal;

a bottom wall having an inner edge connected in proximity to said bottom edge, and an outer edge spaced from said side wall such that said bottom wall is fixed in a cantilevered position with respect to said side wall and wherein said bottom wall and side wall are a monolithic unit; and means for securing cargo to said carrier at a position upon said bottom wall and in proximity to said side wall.

2. A carrier as in claim 1, wherein said bottom wall is substantially planar and said side wall is convex in a direction of extension of said bottom wall, whereby said side wall at least partially conforms to the side of the animal.

3. A carrier as in claim 2, wherein said means for securing cargo comprises a plurality of straps, each mounted to at least one of said side and bottom walls.

4. A carrier as in claim 3, wherein each of said straps includes a length of flexible material surrounding at least one of said side and bottom walls, and further includes means mounted on an end of said length for releasable fixing the other end of said material thereto.

5. A carrier as in claim 4, wherein each of the lengths of material is mounted by at least one ring mounted adjacent at least one edge of the associated one of said side and bottom walls, each of said lengths of material passing through said at least one ring.

6. A carrier as in claim 5, wherein said means for mounting further comprises additional ones of said rings mounted adjacent edges of said side and bottom walls.

7. A carrier as in claim 5, wherein said means for hanging the side wall from the pack animal comprises a pair of hanging loops mounted at spaced positions adjacent said top edge of said side wall and adapted to pass over a protrusion on a saddle mounted on the animal.

8. A carrier as in claim 7, wherein each of said hanging loops is adjustable in length.

* * * * *